US005163631A

United States Patent [19]

Borer

[11] Patent Number: 5,163,631

[45] Date of Patent: Nov. 17, 1992

[54] APPARATUS FOR CONTROLLING CONTACT PRESSURE OF A BOBBIN ON A BEARING ROLLER IN WINDING MACHINE

[75] Inventor: Silvan Borer, Horgen, Switzerland

[73] Assignee: Schaerer Schweiter Mettler AG, Horgen, Switzerland

[21] Appl. No.: 711,598

[22] Filed: Jun. 6, 1991

Related U.S. Application Data

[63] Continuation of Ser. No. 383,908, Jul. 21, 1989, abandoned.

[30] Foreign Application Priority Data

Jul. 22, 1988 [CH] Switzerland ..... 2805/88

[51] Int. Cl.[5] ..... B65H 54/52

[52] U.S. Cl. ..... 242/18 DD; 242/18 B

[58] Field of Search ..... 242/18 DD, 18 R, 65, 242/66, 18 B

[56] References Cited

U.S. PATENT DOCUMENTS 3,617,009 11/1971 Lawson et al. ..... 242/18 R
3,934,830 1/1976 Grau ..... 242/18 DD
4,106,710 8/1978 Schippers et al. ..... 242/18 R
4,538,772 9/1985 Davies ..... 242/18 DD X

FOREIGN PATENT DOCUMENTS 2330504 1/1975 Fed. Rep. of Germany ..... 242/18 DD
3002035 7/1980 Fed. Rep. of Germany ..... 242/18 DD
2253376 6/1975 France ..... 242/18 DD

*Primary Examiner*—Stanley N. Gilreath
*Attorney, Agent, or Firm*—EGLI International

[57] ABSTRACT

In a method and apparatus for controlling a contact pressure which a bobbin being wound with a thread exerts on a roller, the contact pressure is controlled by an adjusting device. The roller is mounted on a balance beam. The divergence of the balance beam from a desired position thereof is determined by a sensor and is converted in a controller into a correction movement of the adjusting device. The adjusting device includes a worn gear with a spindle nut and a spindle driven by a motor which is controlled by the controller. By means of the controller constructed as a control loop, it is possible to very precisely maintain the bearing pressure throughout the winding process independently of the specific weight of the bobbin.

18 Claims, 2 Drawing Sheets

APPARATUS FOR CONTROLLING CONTACT PRESSURE OF A BOBBIN ON A BEARING ROLLER IN WINDING MACHINE

This is a continuation of copending application 07/383,908 filed on Jul. 21, 1989, now abandoned.

BACKGROUND OF THE INVENTION

The present invention relates to a method for controlling a contact pressure with which, in a winding machine during winding, a bobbin to be wound onto a yarn carrier and a roller constructed as a bearing roller, tangential drive roller or grooved drum are pressed against each other, and an apparatus for performing the method.

In the case of a winding machine in which a thread is wound onto a yarn carrier, it is known to drive the bobbin with the aid of a grooved drum or a driving cylinder or roller engaging on the outer circumference of the bobbin. The yarn carrier of the bobbin is normally pivotably mounted in a pivotable or displaceable winding frame. During winding the bobbin engages on the driven roller and by friction contact is rotated by the latter. As the winding of the thread onto the bobbin must permit good unwinding, it is desirable that the driving of the bobbin takes place without slip. It is therefore known to press the bobbin with a specific contact pressure against the bearing roller.

In a known construction the bobbin is arranged above a roller and is held with its yarn carrier in a pivotable winding frame. The winding frame is constructed in such a way that its center of gravity is at a distance from a pivot pin of the winding member so that the weight of the latter presses on the bearing roller. As the bobbin diameter increases the winding member pivots into a position in which the distance between the center of gravity and the pivot pin of the winding member constantly decreases. The consequently constantly decreasing force pressing on the bearing roller as a result of the weight of the winding member, is replaced by the increasing weight of the bobbin. In the case of an even greater bobbin diameter, the center of gravity of the winding member moves from the distance zero towards the pivot pin of the winding member on the opposite side, so that with an increasing bobbin diameter a counterpressure is formed in the sense of relieving the bearing roller of the weight of the bobbin. This makes it possible to control the contact pressure of the bobbin on the bearing roller. However, with this construction the desired contact pressure can only be reached in an approximate manner, because it is dependent on the geometry of the winding frame and the bobbin travel (bobbin shape), as well as the bobbin density.

It is also known to influence the contact pressure of the bobbin on the roller by a counterweight arranged on the winding frame. However, this construction also fails to ensure a precise maintaining of a specific contact pressure.

In a further known construction, the bobbin is arranged laterally in respect to a roller and is pressed onto the latter by springs. For this purpose use is generally made of two oppositely acting spring sets for maintaining the desired contact pressure. However, here again it is only possible to approximately maintain the desired contact pressure.

In yet another known construction, the winding frame is not pivotably mounted about a pivot pin but is instead constructed as a linear guide. If the bobbin is positioned laterally with respect to the roller, then with the aid of a weight guided via a roll, a constant contact pressure of the bobbin on the roller can be achieved. Although admittedly with this construction the desired contact pressure can be precisely maintained, the linear guide represents a relatively complicated and costly solution which makes it difficult to replace the bobbin. It is in particular not possible to arrange the spool or bobbin in a random position with respect to the bearing roller.

SUMMARY OF THE INVENTION

It is an object of the present invention to provide a method and apparatus for controlling contact pressure of a bobbin on a bearing roller, which would avoid disadvantages of the prior art.

It is another object of the present invention to develop a method of the aforementioned type that would make it possible to maintain a precisely prescribed contact pressure throughout the entire winding process, independently of the bobbin density and the bobbin travel.

According to the invention this and other objects are attained in that the bearing pressure on the bobbin forming the controlled variable is controlled by means of a control loop, which sets the position between the bobbin and the roller, the bearing pressure of the bobbin being directly or indirectly measured and divergences thereof from a predetermined desired value are used for correction movements of the control or adjusting device.

The present invention also relates to an apparatus, which solves the problem of controlling in an optimal manner the contact pressure in a winding machine between a bobbin to be wound onto a yarn carrier and a roller constructed as a bearing roller, tangential drive roller or grooved drum.

According to the invention the objects of the invention are also attained by an apparatus in which a yarn carrier or a bearing roller is mounted in rotary manner on one arm of a balance beam having a pivot pin, whilst on the other arm of the balance beam located on the other side of the pivot pin, is displaceably mounted a weight which produces the bearing pressure. A controller is provided in working connection with the balance beam, and in the case of an actual position of the latter, differing from the desired position, the controller controls the contact pressure exerted by the bobbin in the sense of reducing this positional variation.

The invention is described in greater detail hereinafter relative to embodiments and the attached drawings.

DETAILED DESCRIPTION OF THE PREFERRED EMBODIMENTS

Figure 1:
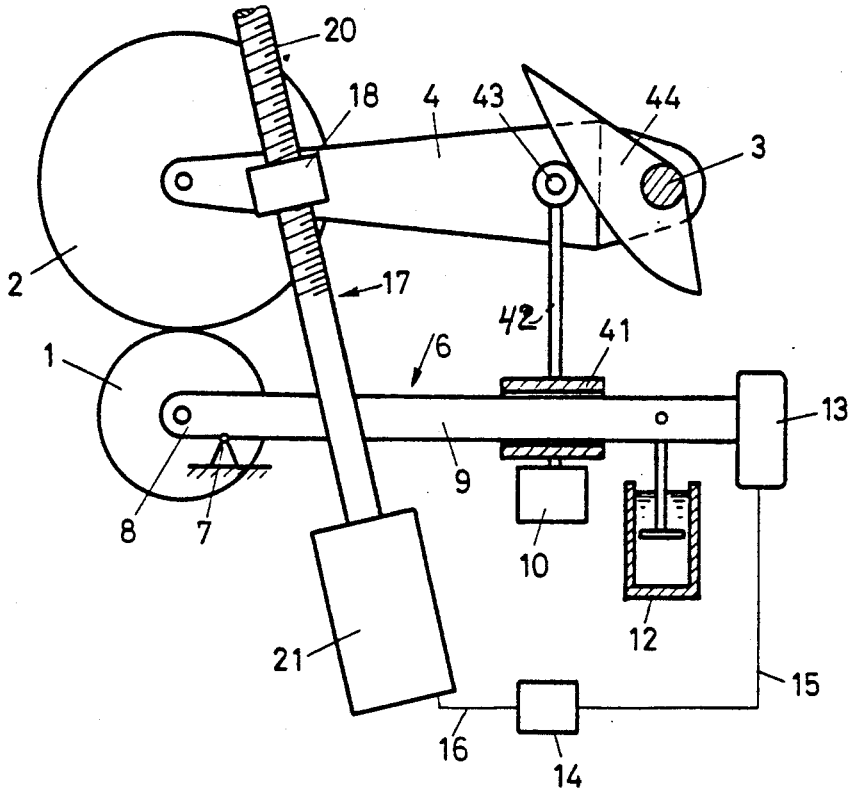
FIG. 1 is a schematic view of an apparatus for controlling a bearing pressure of a bobbin on a roller, in which the bearing pressure is controlled by a control loop during the winding of the bobbin.

The apparatus shown in FIG. 1 comprises a roller 1, which is constructed as a bearing roller, driving roller or grooved drum. Over the roller 1, is arranged a bobbin 2, which is formed by winding a not-shown thread onto a not shown yarn carrier. The yarn carrier is mounted in a winding frame, which is pivotably mounted about a pivot pin 3 and whereof an arm 4 is shown in FIG. 1. It is also possible to construct the winding frame as a linear guide, which is displaceably guided on a column 22 but also has an outwardly extending arm 4, cf. FIG. 2. Roller 1 and the winding frame form parts of a winding machine, such as is used for winding bobbins in outworks and in spinning mills in a number of different constructions.

Roller 1 is mounted in a rotary manner on a balance beam 6, which is pivotable about a pivot joint 7 and has two arms 8, 9 extending in opposite directions from pivot joint 7. One arm 8 is arranged at one side of the pivot joint 7 and carries the roller 1, whilst the other arm 9, located at the opposite side of pivot joint 7, carries a displaceable weight 10. As can be gathered from FIG. 1, the other arm 9 has a much greater length than the arm 8 on which the roller 1 is mounted.

A damping mechanism 12 is coupled to the balance beam 6. The function of damping mechanism 12 is to damp vibrations occurring on balance beam 6. The damping mechanism 12 can be a mechanical, hydraulic or pneumatic throttle member, which is used for braking rapid movements of the balance beam 6 and whereof numerous different constructions are known.

FIG. 1 only shows one pivot joint 7 on one side of the roller 1. However, roller 1 can also be mounted on both sides in two pivot joints 7. However, the construction, in which the roller 1 is mounted on one side in a machine-fixed mounting support and is only supported on the other side in one arm 8 of balance beam 6, is particularly simple.

At the end of the arm 9, is arranged a sensor 13, which establishes or detects divergences of the balance beam 6 from its desired position and produces a corresponding signal, which is supplied via a line 15 to a controller 14, from which by means of a line 16 a corresponding signal is supplied to an adjusting device 17. The latter engages on the arm 4 of the winding frame and respectively adjusts the winding frame in such a way that the balance beam 6 moves towards its desired position. In FIG. 1, the adjusting device 17 is constructed as a worm drive which includes a spindle 20 and a spindle nut 18 connected to arm 4. The spindle 20 driven by a motor 21 cooperates with the spindle nut 18. Motor 21 is controlled by controller 14 via line 16, so that the adjusting device 17 either loads or relieves the bobbin 2 relative to its desired position in the sense of correcting the position of the balance beam 6.

Sensor 13, controller 14 and adjusting device 17 form a control loop which makes it possible to very precisely maintain the contact pressure of bobbin 2 on roller 1. This is assisted by a particularly great length of the arm 9 of the balance beam 6 as compared with that of arm 8.

Figure 2:
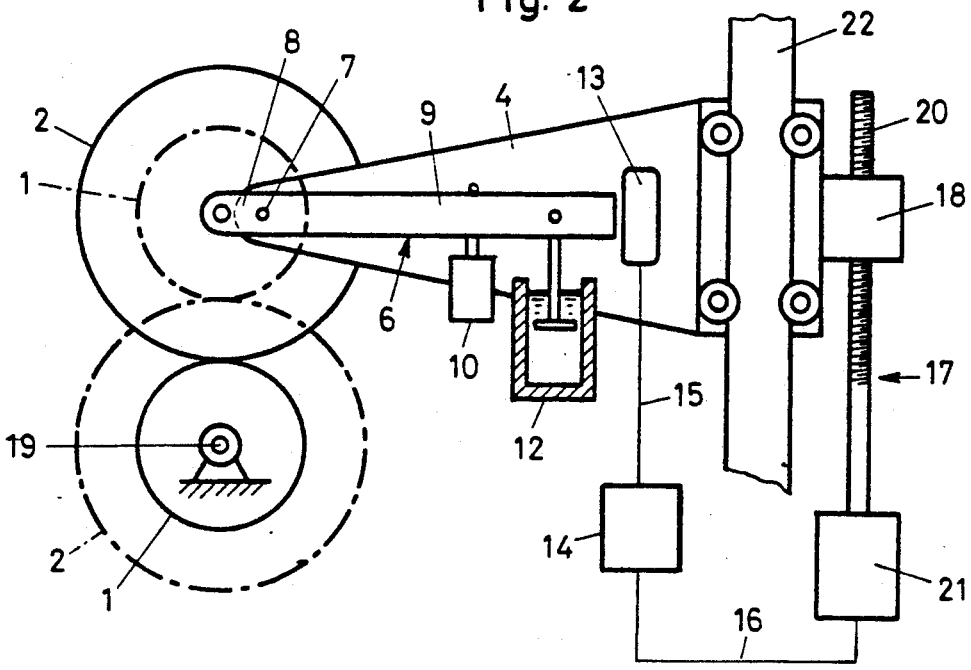
FIG. 2 is a schematic view of a modified embodiment of the apparatus according to FIG. 1 in which, in place of a winding frame pivotable about a pivot pin, a linear guide guided on a column is provided for the bobbin or roller.

The apparatus shown in FIG. 2 has a certain similarity with that of FIG. 1. Here again, the contact pressure is controlled by a control loop, which comprises the balance beam 6 with the displaceable weight 10, sensor 13 and adjusting device 17 including spindle nut 18, spindle 20 and spindle motor 21. Arm 4 of the winding frame is, however constructed in FIG. 2 with a linear guide, but as in FIG. 1, this winding frame could also be replaced by a pivotable winding frame.

FIG. 2 further shows that it is possible to interchange the positions of roller 1 and bobbin 2, so that the roller 1 will be then mounted above the bobbin 2 on the balance beam 6, whereas bobbin 2 will be fixed to the machine. The contact pressure can be controlled just as accurately with this arrangement of bearing roller 1 and bobbin 2. The other reference numerals used in FIG. 2 and which have not been explained in detail correspond to those of FIG. 1.

Figure 3:
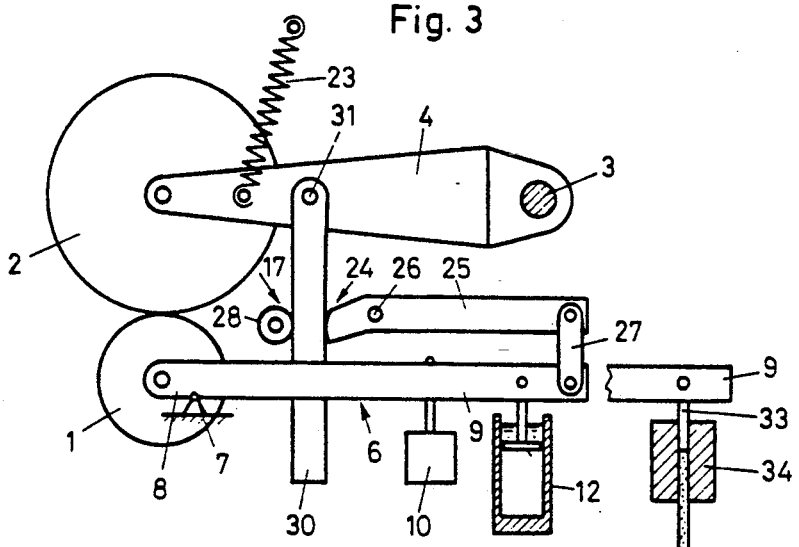
FIG. 3 is a schematic view of a further embodiment of the apparatus for controlling the bearing pressure of a bobbin on a roller, in which the control of the bearing pressure of the bobbin on the roller is carried out by a stepping mechanism.

FIG. 3 shows a further embodiment of the apparatus for controlling the bearing pressure of bobbin 2 on roller 1. In the case of this embodiment, as with that of FIG. 1, the roller 1 is mounted on the balance beam 6, which is supported on the pivot joint 7. Bobbin 2 is mounted in the pivotable winding frame with arm 4. The winding frame is also pre-tensioned by a spring 23 in such a way that it acts in the sense of reducing the bearing pressure of bobbin 2. In the case of the embodiment of FIG. 3, the balance beam 6 is mechanically coupled to the adjusting device 17, which is constructed as a stepping mechanism. The adjusting device 17 essentially comprises a clamping device 24 and a link plate 27, which is coupled to one end of the longer arm 9 of the balance beam 6. A clamping lever 25 pivotable about a pivot pin 26, together with a clamping roll 28, forms the clamping device 24 used for clamping an adjusting rod 30 and releasing the same in stepwise manner. The adjusting rod 30 is articulated by means of a pivot joint 31 on the winding frame arm 4.

The apparatus shown in FIG. 3 operates as follows: As a thread is wound onto the bobbin 2, the diameter of the latter increases and the bobbin thus presses more strongly onto the bearing roller 1. As a result, arm 9 of balance beam 6 is raised, so that the clamping lever 25 is pivoted to a position in which it releases the adjusting rod 30. Through the pre-tensioned spring 23, the winding member is now raised until the pressure on the bearing roller 1 is reduced to such an extent that the balance beam 6 pivots back into its desired position and, simultaneously, the adjusting rod 30 is locked by the clamping lever 25. Therefore the control of the bearing pressure takes place in small steps, in each case preceded by a deflection of the balance beam 6 from its desired position. However, these steps can be kept so small that it is possible to maintain a constant bearing pressure of bobbin 2.

Figure 4:
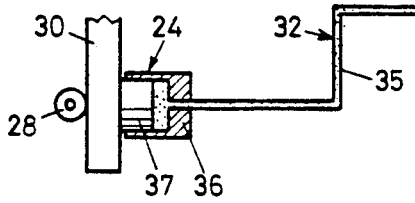
FIG. 4 schematically shows a part of the apparatus according to FIG. 3 with a hydraulic transmission system.

FIG. 4 shows the embodiment in which the clamping device 24 includes a hydraulic system 32, which is operated by the balance beam 6. For this purpose, a piston 33 is fixed to the end of arm 9, whereof only part is shown and which cooperates with a cylinder 34. From cylinder 34 a pressure line 35 leads to a cylinder 36, in which is guided a clamping piston 37. The latter presses against the adjusting rod 30 and forms with the clamping roll 28 the clamping device operated to effect the movement and release of adjusting rod 30 in the same manner as that of clamping device 24 of FIG. 3.

If the roller 1 pivots upwards as a result of the increased weight of bobbin 2 with its arm 9, then the pressure in pressure line 35 is reduced, so that the clamping device 24 frees the adjusting rod 30 until arm 8 has again assumed its desired position and has consequently relocked the adjusting rod 30. It would also be possible to replace the hydraulic system 32 by a pneumatic system.

Figure 5:
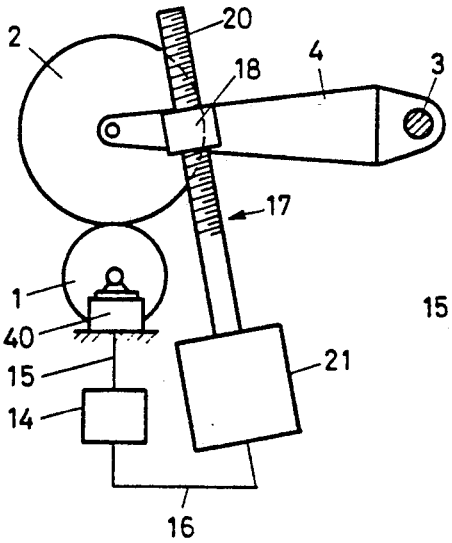
FIG. 5 is a schematic view of yet another embodiment of the apparatus for controlling the bearing pressure of a bobbin on a roller by means of a control loop, in which the bearing pressure is directly measured on the roller bearing.
Figure 6:
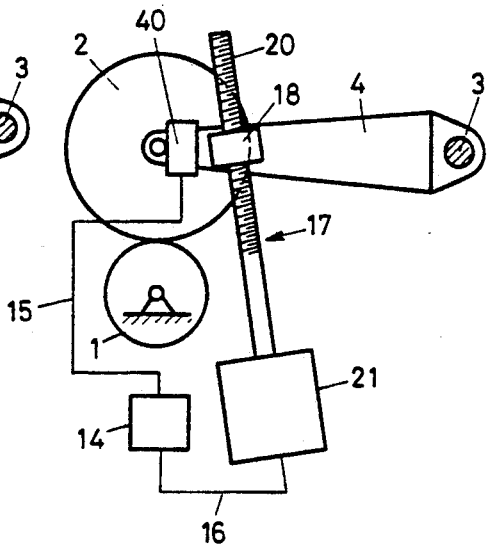
FIG. 6 is a schematic view of still a further embodiment of the apparatus for controlling the bearing pressure of a bobbin on a roller by means of a control loop, in which the bearing pressure is directly measured on the bobbin bearing.

FIGS. 5 and 6 show two further embodiments of the apparatus for controlling the bearing pressure of bobbin 2 on roller 1. In place of balance beam 6 with weight 10, in the case of the constructions according to FIGS. 5 and 6, the indirect generation and measurement of the bearing pressure is replaced by a sensor, which directly measures the bearing pressure. For this purpose in the case of the construction according to FIG. 5, a sensor 40 is provided, which measures the bearing pressure on the mounting support of roller 1. In the embodiment of FIG. 6, the sensor 40 is arranged on the mounting support of bobbin 2 and measures the bearing pressure at this point. In the controller 14, this measured actual value is compared with a desired value, and divergences from the desired value are used for operating the adjusting or control mechanism 17. Thus, in the two constructions according to FIGS. 5 and 6, use is once again made of a closed control loop with feedback, such as is the case of the constructions according to FIGS. 1 to 4. Thus, on the basis of the different construction possibilities shown in FIGS. 1 to 6, it is possible to use the most appropriate solution for a particular application.

The described embodiments of the apparatus according to the present invention, are characterized in that the bearing pressure can be maintained independently of the specific gravity or weight of the bobbin, the bobbin shape (bobbin travel and bicone) and the winding frame geometry. The bearing pressure is precisely adjustable and can be carried out easily. No prior calibration is required, because in the case of the embodiments of FIGS. 1 to 4, the bearing pressure can be adjusted by moving a relatively small weight 10. In the embodiments of FIGS. 5 and 6, it is possible to choose the bearing pressure on the bobbin by setting a desired value on controller 14.

If a change to the bearing pressure is desired during winding, this can be brought about with a simple addition, which is shown in FIG. 1. The weight 10 is hung on a sliding sleeve 41, whilst a feeler 42 with a feeler roll 43 is fixed to the top of sleeve 41. On arm 4, is arranged a link 44, along a cam surface of which moves the feeler roll 43 during winding and displaces the weight 10 on balance beam 6. Such devices for modifying the bearing pressure can naturally be also provided in the embodiments of FIGS. 2 to 6. In the constructions shown in FIGS. 5 and 6, the controller 14 can be constructed as a servo-mechanism, in which the desired value will be modified as a function of time or diameter of bobbin 2.

The described embodiments of the apparatus can also be subsequently fitted to existing winding machines, because no specific arrangement of roller 1 and bobbin 2 is required.

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An apparatus for controlling contact pressure between a bobbin and a roller comprising:

a balance beam pivotally mounted on a pivot joint, said balance beam having a first arm mounted on a first side of said pivot joint, said first arm holding a roller, and a second arm mounted on a second side of said pivot joint, a bobbin connected to a winding frame arm, said winding frame arm connected to said balance beam and operable to change the position of said second arm of said balance beam, said roller in contact with said bobbin;

sensing means for sensing an angular position of said balance beam; and adjusting means responding to an output of said sensing means for adjusting the relative positions of said bobbin and said balance beam causing said roller to be in constant contact pressure with said bobbin.

2. An apparatus according to claim 1 wherein said adjusting means comprises:

control means for receiving said output of said sensing means and outputting a control signal;

worm gear means connected to said winding frame arm for adjusting the position of said bobbin; and a motor for driving said worm gear means in response to said control signal.

3. An apparatus according to claim 2, wherein said second arm of said balance beam is greater in length than said first arm of said balance beam.

4. An apparatus according to claim 1, wherein said sensing means senses divergences between a desired position and an actual position of said balance beam.

5. An apparatus according to claim 1, wherein said second arm of said balance beam is connected to a displaceable weight, said displaceable weight cooperating with a linking device, said linking device connecting said winding frame arm to said balance beam, said displaceable weight being operable to move along the length of said second arm to produce bearing weight causing said first arm to displace said roller.

6. An apparatus according to claim 1, wherein said roller is a bearing roller.

7. An apparatus according to claim 1, wherein said roller is a tangential drive roller.

8. An apparatus according to claim 1, wherein said roller is a groove drum.

9. An apparatus according to claim 1, wherein said second arm is connected to a damping means for reducing vibrations in said balance beam.

10. An apparatus for maintaining a predetermined contact pressure between a bobbin to be wound with yarn and a roller, said apparatus comprising:

a bobbin for winding with yarn, said bobbin connected to a winding frame arm;

a roller;

a balance beam pivotally mounted on a pivot joint, said balance beam having a first arm mounted on a first side of said pivot joint, said first arm holding said roller, and a second arm mounted on a second side of said pivot joint, said balance beam having a preferred horizontal orientation in which a predetermined contact pressure is applied between said roller and said bobbin;

sensing means disposed at the end of said second arm of said balance beam for sensing angular displacement of said balance beam about said pivot joint and generating an output signal when the weight of said bobbin winding with yarn increases and tilts said balance beam from its preferred horizontal orientation; and adjusting means for adjusting the relative positions of said bobbin and said balance beam in response to the output signal of said sensing means to maintain said balance beam in a desired angular position in order to maintain the contact pressure between said roller and said bobbin.

11. An apparatus according to claim 10, wherein said adjusting means comprises:

control means for receiving said output of said sensing means and outputting a control signal;

worm gear means connected to said winding frame arm for adjusting the position of said bobbin; and a motor for driving said worm gear means in response to said control signal.

12. An apparatus according to claim 10, wherein said sensing means detects divergences between a desired position and an actual position of said balance beam.

13. An apparatus according to claim 10, wherein said second arm of said balance beam is greater in length than said first arm of said balance beam.

14. An apparatus according to claim 10, wherein said second arm of said balance beam is connected to a displaceable weight, said displaceable weight cooperating with a linking device, said linking device connecting said winding frame arm to said balance beam, said displaceable weight being operable to move along the length of said second arm to produce bearing weight thereby causing said first arm to displace said roller.

15. An apparatus according to claim 10, wherein said roller is a bearing roller.

16. An apparatus according to claim 10, wherein said roller is a tangential drive roller.

17. An apparatus according to claim 10, wherein said roller is a groove drum.

18. An apparatus according to claim 10, wherein said second arm is connected to a damping means for reducing vibrations in said balance beam.

* * * * *